United States Patent [19]

Pajula

[11] Patent Number: 4,932,578

[45] Date of Patent: Jun. 12, 1990

[54] ADJUSTABLE GUIDE ASSEMBLY FOR MOVING WEBS OR FABRICS

[75] Inventor: Juhani Pajula, Jyväskylä , Finland

[73] Assignee: Valmet Paper Machinery Inc., Finland

[21] Appl. No.: 244,501

[22] Filed: Sep. 14, 1988

[30] Foreign Application Priority Data

Sep. 18, 1987 [FI] Finland ..... 874092

[51] Int. Cl.[5] ..... B65H 20/00

[52] U.S. Cl. ..... 226/194; 226/18; 384/247; 384/256

[58] Field of Search ..... 226/15, 16, 17, 18, 226/19, 20, 21, 22, 23, 190, 194, 196, 199; 384/99, 558, 581, 535, 495, 247, 252, 256

[56] References Cited

U.S. PATENT DOCUMENTS

| | | | |
|---|---|---|---|
| 3,101,005 | 8/1963 | Mittag | 226/21 X |
| 3,750,920 | 8/1973 | Fountain et al. | 226/23 |
| 3,841,722 | 10/1974 | Lehtonen | 384/256 |
| 3,966,106 | 6/1976 | Randpalu | 226/194 X |
| 4,610,739 | 9/1986 | Jensen | 226/15 X |
| 4,666,073 | 5/1987 | DuFour | 226/23 |

FOREIGN PATENT DOCUMENTS

| | | | |
|---|---|---|---|
| 549133 | 6/1956 | Belgium | 226/23 |

*Primary Examiner*—Katherine A. Matecki

*Attorney, Agent, or Firm*—Steinberg & Raskin

[57] ABSTRACT

An adjustable guide assembly for a moving web or fabric. The guide assembly includes a bearing housing adapted to receive a bearing carrying an axle journal of a web or fabric guide roll and a pair of bellows mounted on opposite sides of the bearing housing, and wherein the bearing housing is movable with respect to a fixed frame for positioning the end of the web guide roll through adjustment of the fluid pressure within the bellows. Each of the bellows has a fluid space therewithin in which are situated a first bearing lug which is fixed in position relative to the fixed frame and a second bearing lug fixed to the movable bearing housing, the first and second bearing lugs having pivot points to which a connecting arm member is pivotally connected.

10 Claims, 4 Drawing Sheets

X
Y
K1
10
11
12
13
14
15
16
17
17a
17b
18
18a
18b
19a1
19a2
19b1
19b2
20a1
20a2
20b1
20b2
21
21a
21b
21c
22
23
24
25
26
27
28
29
30
31
32
33
34
35
36
37
38
39
40
41
42
50
51

ADJUSTABLE GUIDE ASSEMBLY FOR MOVING WEBS OR FABRICS

BACKGROUND OF THE INVENTION

The present invention relates to adjustable guide assemblies for adjusting the direction of a web or fabric moving over a guide roll with respect to a fixed frame.

Guide assemblies for controlling the lateral position of a moving web are known wherein the guide roll bearing on one axle journal is guided laterally in a horizontal direction for displacing the roll relative to the direction of travel of the web.

Lateral guide assemblies for moving webs are known in which bellows are provided at opposite sides of a bearing housing into which fluid pressure is introduced to displace the bearing housing in a desired direction. In such prior art assemblies, the bearing housing is disposed to move horizonally on separate guide rails. Although a number of different designs for such guide assemblies are known, all are subject to the drawback that the bearings are open and unprotected and therefore tend to accumulate dirt during operation. This is detrimental, particularly in the paper industry.

SUMMARY OF THE INVENTION

An object of the present invention is to provide new and improved guide assemblies for adjusting the direction of a web or fabric moving over a guide roll with respect to a fixed frame.

Another object of the present invention is to provide new and improved guide assemblies of the type described above having a compact, enclosed construction.

Still another object of the present invention is to provide new and improved guide assemblies of the type described above comprising modular-type bellows units associated with a bearing housing which are replaceable as units in a quick and easy fashion.

A further object of the present invention is to provide new and improved guide assemblies of the type described above which can operate in any position, such as upside-down, and which therefore may be used as a vertical guide assembly as well as a horizontal guide assembly.

Briefly, in accordance with the present invention, these and other objects are obtained by providing a guide assembly comprising a bearing housing adapted to receive a bearing carrying an axle journal of the guide roll and first and second bellows mounted on respective opposite sides of the bearing housing and wherein situated within the fluid space of each of the bellows is a suspension construction including a first bearing lug fixed to the fixed frame and providing a first pivot point thereon, a second bearing lug fixed to the movable bearing housing and having a second pivot point thereon, and a connecting arm member pivotally connected to the pivot points of the first and second bearing lugs.

A guide assembly in accordance with the invention comprises a compact bellows construction including bellows which are replaceable as modules or units, and within each of which is a suspension construction for a bearing housing which includes a first bearing lug including a first pivot point located in a fixed position relative to the fixed frame and a second bearing lug including a second pivot point located in a fixed position relative to the movable bearing housing, and to which a connecting arm member is pivotally connected so as to be turnable. Bellows of substantially identical construction are positioned on either side of the bearing housing. The location of the pivot points may be varied to achieve a desired path of movement of the bearing housing.

DESCRIPTION OF THE DRAWINGS

A more complete appreciation of the present invention and many of the attendant advantages thereof will be readily understood by reference to the drawings herein which illustrate embodiments to which the invention is not exclusively limited, and wherein.

DETAILED DESCRIPTION OF THE PREFERRED EMBODIMENT

Figure 1:
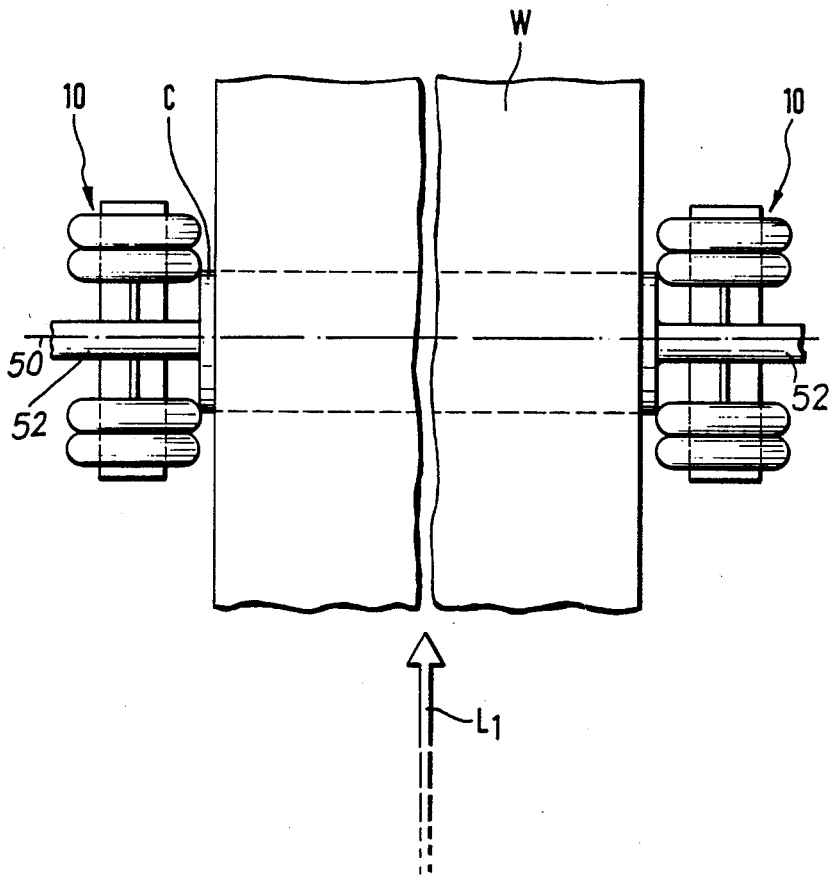
FIG. 1 is a schematic plan view of a pair of guide assemblies for adjusting the direction of a web moving over a guide roll.

Referring now to the drawings wherein like reference characters designate identical or corresponding parts throughout the several views, and more particularly to FIG. 1, the invention illustrated is applied in a paper machine wherein a web W is moving in a direction designated by the arrow $L_1$. A guide assembly 10 in accordance with the invention is provided on both ends of a guide roll C of the web W.

Figures 2, 3:
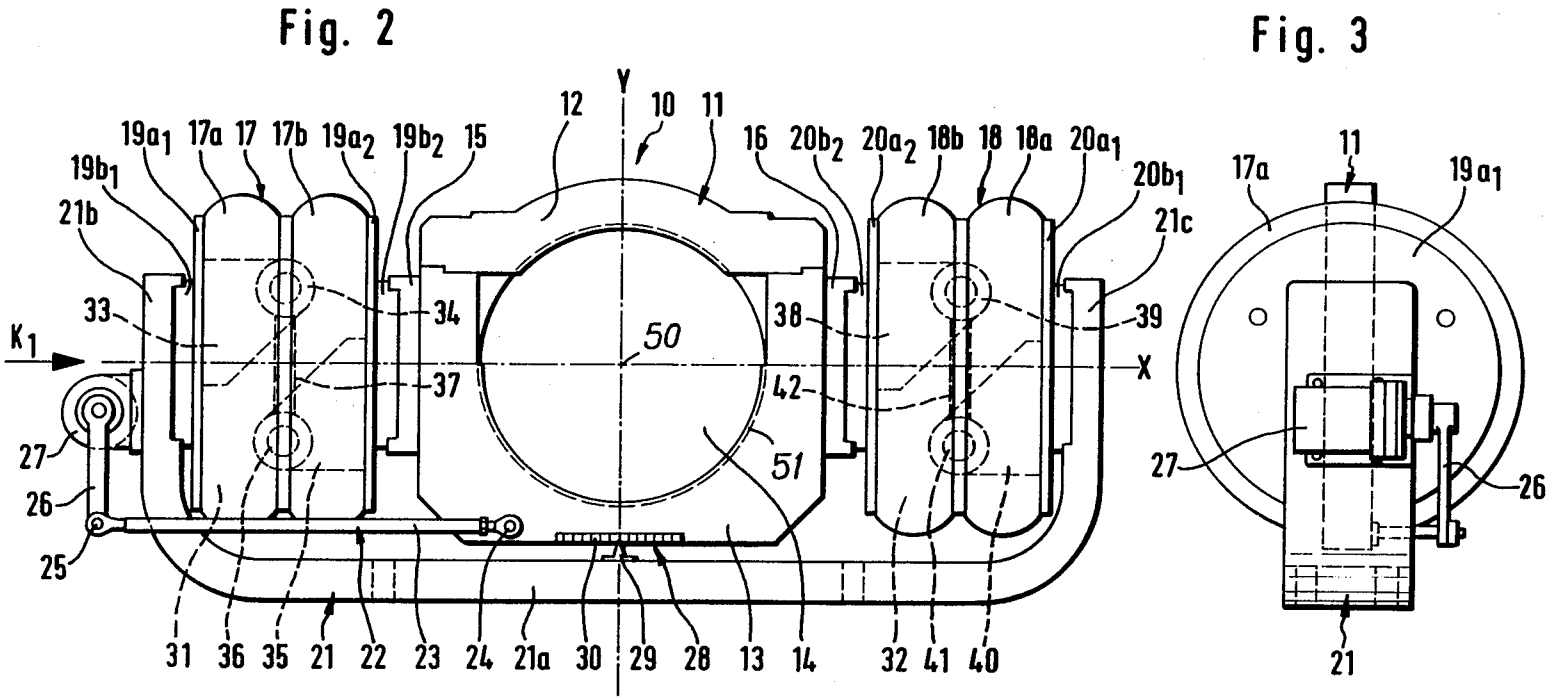
FIG. 2 is a side elevation view of a guide assembly in accordance with the invention.
FIG. 3 is a view of the guide assembly illustrated in FIG. 2 in the direction of arrow $K_1$ in FIG. 2.

Referring now to FIG. 2, the guide assembly 10 in accordance with the invention comprises a bearing housing 11 adapted to receive a bearing 51 carrying an axle journal 52 (FIG. 1) of the guide roll, the journal having a central axis 50. The bearing housing 11 comprises a bearing housing cover 12 which is detachably connected to a frame 13 of the bearing housing, such as by threaded fasteners (not shown). A central bearing space 14 of the bearing housing is defined between the frame 13 and cover 12 in which the bearing 51 carrying the journal 52 of the guide can be mounted. The bearing 51 preferably comprises a spherical bearing.

The guide assembly 10 further comprises first and second bellows 17 and 18 situated on respective sides of the vertical central axis Y of the bearing housing 11. A first bellows mounting flange 15 extends from one side of the bearing frame 13, and similarly, a second bellows mounting flange 16 extends from the other side of the bearing frame 13.

The first bellows 17 comprises a unitary component including a first bellows section **17*a* and a second bellows section 17*b*. Similarly, the second bellows 18 situated on the other side of the central axis Y of bearing housing 11 comprises a first bellows section 18*a* and a second bellows section 18*b*. First and second bellows 17 and 18** preferably are formed of a resilient, elastic material.

As seen in FIGS. 2 and 3, the guide assembly 10 further comprises a fixed frame 21 including a horizontal frame section 21a and a pair of spaced vertical frame sections 21b and 21c. First bellows 17 is attached to frame section 21b and one side of bearing housing 11 by fixing elements 19a$_1$, 19b$_1$, and 19a$_2$, 19b$_2$ respectively. Similarly, second bellows 18 is attached to frame section 21c and the other side of bearing housing 11 by fixing elements 20a$_1$, 20b$_1$ and 20a$_2$, 20b$_2$ respectively.

More particularly, the first bellows 17 comprises a first fixing flange 19a$_1$ and a second fixing flange 19a$_2$ extending from the respective outer sides of the first bellows section 17a and the second bellows section 17b. Similarly, the second bellows 18 comprises a first fixing flange 20a$_1$ and a second fixing flange 20a$_2$ extending from the respective outer sides of the first and second bellows sections 18a and 18b respectively.

A small diameter fixing member 19b$_1$ is associated with and extends from the first fixing flange 19a$_1$ for detachable connection to the vertical frame section 21b of fixed frame 21, such as by threaded fasteners (not shown). Similarly, a smaller diameter fixing member 19b$_2$ is associated with and extends from the second fixing flange 19a$_2$ for detachable connection to the mounting flange 15 of bearing frame 13, preferably with threaded fasteners.

Similar fixing members 20b$_1$ and 20b$_2$ are associated with and extend from the first and second fixing flanges 20a$_1$ and 20a$_2$ of second bellows 18 for detachably connecting the same to the vertical frame section 21c of fixed frame 21 and to the mounting flange 16 provided on the other side of bearing housing 11.

In accordance with the invention, the first and second bellows 17 and 18 have similar modular or unitary construction and are each separately detachable from the bearing housing and fixed frame for maintenance purposes. In this manner, each or both of the first and second bellows 17 and 18, along with the suspension construction situated therein, can be detached as a unit for maintenance purposes whereupon replacement bellows can immediately be installed in their place to avoid lengthy down time for the paper machine.

Further, in accordance with the invention, the bellows 17 and 18 have substantially similar structural components thereby reducing the number of frame components necessary which in turn reduces production costs. By constructing the fixing members 19b$_1$ and 19b$_2$ of first bellows 17 to be substantially identical, the bellows 17 can be inverted or reversed in position for reasons discussed below. Similarly, the second bellows 18 can be inverted in position by providing the fixing members 20b$_1$ and 20b$_2$ to be of substantially the same construction. If the fixing members are formed symmetrically, the bellows can be turned upside-down for reasons discussed below.

Still referring to FIG. 2, a fluid space 31 is defined within first bellows 17 into which a pressurized fluid (or underpressure) can be introduced for moving the bearing housing 11 in a horizontal direction. The second bellows 18 similarly defines a fluid space 32 into which pressurized fluid (or underpressure) can be introduced for moving the bearing housing 11 in a desired direction. In this connection, compressed air or hydraulic liquid can be introduced into the fluid spaces 31 and/or 32 of either one or both bellows 17 and/or 18.

The guide assembly 10 also comprises a first position measuring means 22 seen in FIGS. 2 and 3. The first position measuring means 22 comprises a horizontal rod component 23 which is pivotally mounted to the bearing frame 13 of housing 11 by a bearing 24, a second rod 26 pivotally mounted to the other end of the rod component 23 by a bearing 25 and coupled to an angular position measuring means 27, such as a potentiometer, which detects the angular position of the rod 26 and, in turn, the position in a horizontal direction of the bearing housing 11. The potentiometer can generate a signal indicative of the position of the bearing housing which is input to guide position remote control apparatus.

The guide assembly 10 further comprises a second detector means 28 which registers the position of the bearing housing 11 which respect to the fixed frame 21. The second detector means 28 comprises a position pointer 29 mounted on the fixed frame 21 and a scale 30 mounted on the bearing housing frame 13 and which moves therewith. The position of the bearing housing 11 is indicated by the position of the pointer 29 on the scale 30.

Within each of the fluid spaces 31 and 32 of each of the first and second bellows 17, 18 is situated suspension means for the bearing housing 11. The suspension means provided in bellows 17 and 18 are substantially structurally the same and will be described below in connection with first bellows 17.

Figure 4:
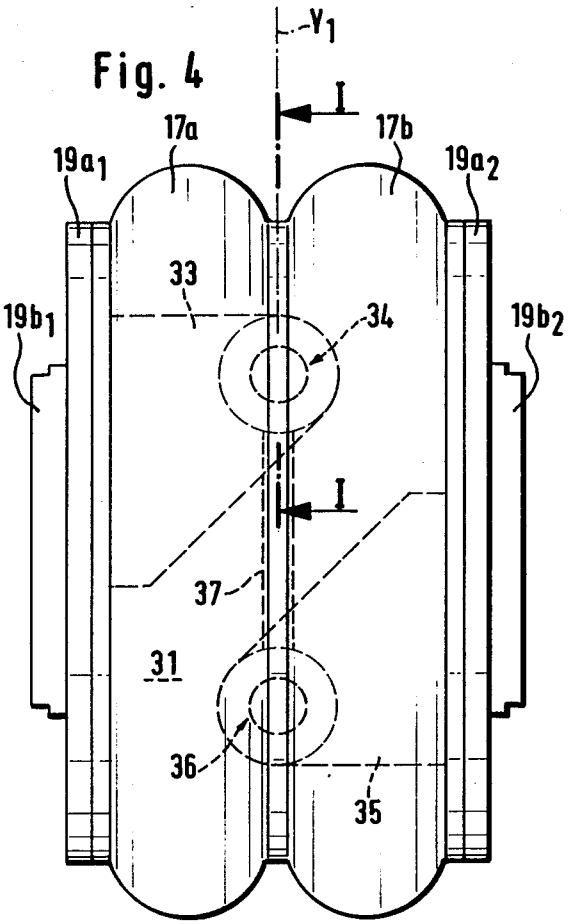
FIG. 4 is an enlarged elevation view of a bellows unit comprising a component of a guide assembly in accordance with the invention, the bearing lugs and the connecting arm member being shown in phantom.

Thus, referring to FIGS. 2 and 4, the first bellows 17 contains a first bearing lug 33 situated within the pressurized fluid space 31 of the first bellows 17 which is fixed to the first fixing flange 19a$_1$ so that the first bearing lug 33 is fixed with respect to the fixed frame 21. A connecting arm member 37 situated within the fluid space 31 of bellows 17 is connected at one end to a pivot point of the first bearing lug 33 by means of a bearing 34, and at its other end to a pivot point of the second bearing lug 35 by means of a bearing 36. The second bearing lug 35 is fixed to the second fixing flange 19a$_2$ and is thereby fixed with respect to the frame 13 of bearing housing 11. The connecting arm member 37 is thereby turnably pivoted at both of its ends on lugs 33 and 35 at pivot points 34 and 36.

Equivalent structural components are provided within the fluid space 32 of the second bellows 18. In particular, a first bearing lug 38 is fixedly connected to the second fixing flange 20a$_2$ and thereby to the frame 13 of housing 11 while a second bearing lug 40 is fixedly connected to the second fixing flange 20a$_1$ and thereby to the fixed frame 21. The first lug 38 comprises a pivot point to which one end of a connecting arm member 42 is pivotally connected by a bearing 39 and, similarly, the second bearing lug 40 comprises a pivot point at which the other end of the connecting arm member 42 is pivotally connected by a bearing 39.

In the embodiments illustrated in FIGS. 2 and 3, the pivot point or bearing 34 of the first lug 33 of the first bellows 17 is located above a longitudinal central axis X of the guide assembly while the pivot point or bearing 36 of the second lug 35 is correspondingly located below the central axis X. The pivot point or bearing 39 of the first lug 38 of the second bellows 18 is situated above the central axis X while the pivot point or bearing 41 of the second lug 40 is correspondingly located below the central axis X. Therefore, in the embodiment illustrated in FIG. 2, when the bearing housing 11 moves from its central axis Y in one or the other direction, the movable pivot point or bearing 36 of the bearing lug 35 in the pressurized fluid space 31 of first bellows 17 will rise in an upward direction, and correspondingly, the movable pivot point or bearing 39 of the bearing lug 38 in the pressurized fluid space 32 of the second bellows 18 will desend. In this manner, the center 50 of the journal 52 of the guide roll mounted in the bearing housing 11 will remain at the same horizontal position.

It will be understood by those skilled in the art that if the first bellows 17 is inverted in position such that the fixed lug 33 with its pivot point or bearing 34 is situated below the central axis X while the movable lug 35 with its movable pivot point or bearing 36 lies above the central axis X, while the bellows 18 remains in the same position shown in FIG. 2, horizontal displacement of the center of the guide roll will follow a convex path. In the central position of guide assembly 10, when the connecting arm members 37 and 42 are positioned with their central axes in a vertical configuration, the centerpoint 50 of the journal 52 is positioned at the topmost point of a convex path so that when the guide assembly is moved in either direction from the central position, the position of the journal center 50 will descend.

Figure 6:
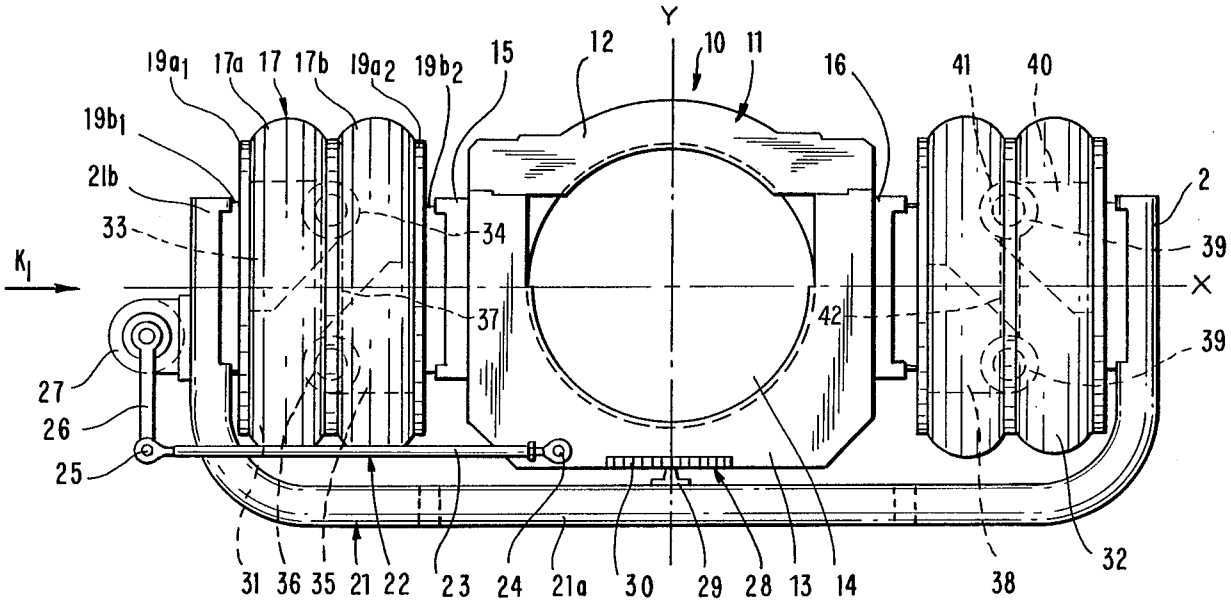
FIG. 6 is a side elevational view of an alternative embodiment of a guide assembly in accordance with the invention.

It will also be understood by those skilled in the art that if the suspension construction within the first bellows 17 remains in the position illustrated in FIG. 2 and the position of second bellows 18 is inverted so that the lug 38 fixed to the frame 13 of moveable bearing housing 11 together and its bearing or pivot point 39 is situated below the central axis X while the bearing lug 40 fixed to the fixed frame 21 and its pivot point or bearing 41 is situated above the central axis, the path of the center of the roll shaft will be concave (FIG. 6). Thus, when the connecting arm members 37 and 42 are in a vertical configuration, the center 50 of the journal 52 is in its lowermost position. Displacement of the bearing housing 11 in either direction by adjusting the fluid pressure in one or both of the bellow 17 and/or 18 will cause the location of the center 50 of the roll to rise. When no fluid pressure is applied to either one of the bellows 17 and 18, the weight of the roll urges the bearing housing 11 into a center position so that in this embodiment, the guide assembly is self-centering.

Referring now to FIG. 4 wherein the first bellows 17 is shown on a larger scale, the suspension construction is substantially identical to that of bellows 18 except that the location of the pivot points of the first and second bearing lugs may differ depending upon the position of the bellows as described above. The entire bellows structure 17 is detachable as a unit from the guide assembly for maintenance purposes.

As pointed out above, the bellows structure 17 comprises a first bellows section 17*a* and a second bellows section 17*b*. A pressurized fluid space 31 is provided within the bellows 17 into which pressurized fluid can be introduced through either one or both flanges $19a_1$ and/or $19a_2$. The flange $19a_1$ is connected on one side to the first bellows section 17*a* and is connected on its other side to the fixing member $19b_1$. The other half of the bellows is similar in construction and comprises the bellow section 17*b* to which the flange $19a_2$ is connected on one side and on its other side to the fixing member $19b_2$.

By designing the fixing members $19b_1$ and $19b_2$ and the mating coupling components 21*b*, 15 to which they are to be connected so as to be substantially the same in design, the bellows stucture can be turned in accordance with its intended use so that the position of the pivot points or bearings 36 and 34 can be reversed with respect to the central axis X.

As noted above, the first bearing lug 33 is attached to the flange $19a_1$ and comprises a pivot point or bearing 34 while the flange $19a_2$ is fixed to the second bearing lug 35 comprising the pivot point or bearing 36. The connecting arm 37 is pivotally attached at one of its ends to the pivot or bearing 34 and at the other of its ends to the pivot point or bearing 36. The bellows structure 17*a*, 17*b* proper surrounding the pressurized fluid space 31, preferably comprises an elastic, yielding material.

Figure 5:
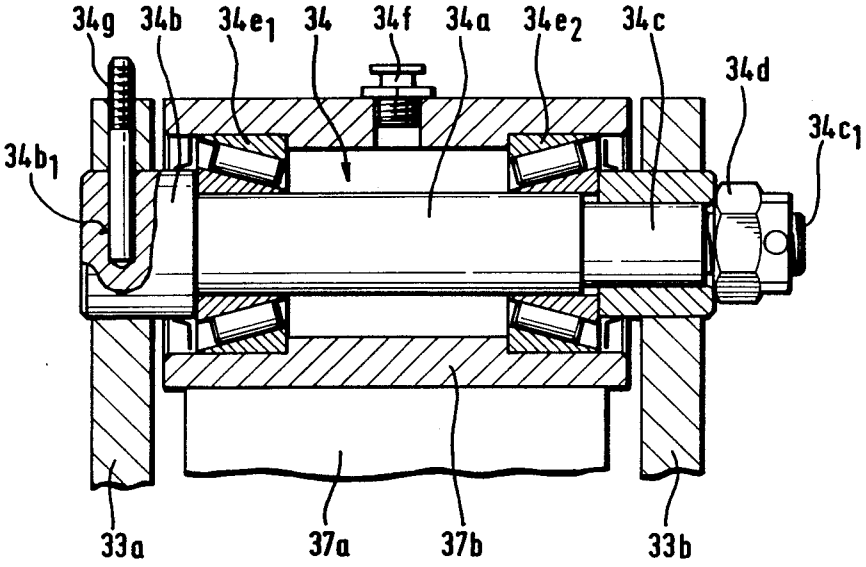
FIG. 5 is a view taken along line I—I of FIG. 4.

Referring now to FIG. 5, the connecting arm member 37 comprises an arm section 37*a* and a sleeve section 37*b* at its end. The arm member 37 is situated between the first and second plates 33*a* and 33*b* forming the first bearing lug 33. The pivot point or bearing 34 comprises a bearing axle 34*a* having an axle section 34*c* at one of its ends which is provided with threads $34c_1$. The other end of bearing axle 34*a* comprises an axle section 34*c* through which a hole $34a_1$ is provided for receiving a cotter pin 34*g*. The bearing axle 34*a*, 34*b*, 34*c* passes between the plates 33*a* and 33*b* of the first bearing lug 33 and is fixed relative to the plates by means of the cotter pin 34*g*. A nut 34*d* is fastened to the threaded end of the axle.

Bearing means $34e_1$ and $34e_2$ are provided within the sleeve 37*b* of connecting arm member 37. These bearing means advantageously comprise conical roller bearings which provide accurate rotation which is substantially free of play. The connecting arm member 37 turns relative to the axle 34*a* carried by bearings $34e_1$ and $34e_2$. The sleeve portion 37*b* of connecting arm member 37 further carries a grease nipple 34*f* through which the bearing means $34e_1$ and $34e_2$ can be lubricated.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A guide assembly for adjusting the direction of a web or fabric moving over a guide roll with respect to a fixed frame, comprising:

a movable bearing housing adapted to receive a bearing carrying an axle journal of the guide roll;

first and second bellows, each mounted on a respective side of said bearing housing and on respective sides of said fixed frame, and defining an internal protected fluid space; and wherein said fluid space of each of said first and second bellows has situated therewithin, a first bearing lug having a first pivot point fixed with respect to said fixed frame, a second bearing lug having a second pivot point fixed with respect to said movable bearing housing; and a connecting member pivotally connected at said first and second pivot points to said first and second bearing lugs;

said second pivot points each being arranged to move from a respective central position thereof along curved paths determined by said respective connecting members pivotally connected thereto and pivotally connected to said respective first pivot points, the movement of said second pivot points along said curved paths causing the center of said axle journal to be displaced only horizontally, whereby said bearing housing is movable with respect to said fixed frame for positioning the axle journal of the guide roll by adjusting the pressure within said fluid space of at least one of said bellows to adjust the direction in which the web moves.

2. The bearing assembly of claim 1 wherein, said first and second bellows each includes first mounting means for mounting said bellows to said fixed frame and second mounting means for mounting said bellows to said bearing housing; and said first and second mounting means are substantially identical;

whereby the position of each of said bellows can be inverted with respect to said fixed frame and bearing housing.

3. The guide assembly of claim 1 wherein said guide assembly includes means for detecting the position of said bearing housing relative to said fixed frame and for generating and sending a signal indicative of said relative position to apparatus for controlling the position of said bearing housing relative to said fixed frame.

4. The guide assembly of claim 3 wherein said position detecting means comprise a rod having one end pivotally connected to said bearing housing, an arm having one end pivotally connected to another end of said rod, and wherein said arm has another end coupled to angular position measuring means.

5. The guide assembly of claim 4 wherein said angular position measuring means comprises a potentiometer for generating a signal indicative of the angular position of said arm which is in turn indicative of the position of said bearing housing relative to said fixed frame.

6. A guide assembly for adjusting the direction of a web or fabric moving over a guide roll with respect to a fixed frame, comprising:

a movable bearing housing adapted to receive a bearing carrying an axle journal of the guide roll;

first and second bellows, each mounted on a respective side of said bearing housing and on respective sides of said fixed frame, and defining an internal fluid space; and wherein said fluid space of each of said first and second bellows has situated therein, a first bearing lug having a first pivot point fixed with respect to said fixed frame;

a second bearing lug having a second pivot point fixed with respect to said movable bearing housing; and a connecting member pivotally connected at said first and second pivot points to said first and second bearing lugs, whereby said bearing housing is movable with respect to said fixed frame for positioning the axle journal of the guide roll by adjusting the pressure within said fluid space of at least one of said bellows to adjust the direction in which the web moves; and wherein, a central axis which passes through the center of said axle journal and both said fluid spaces;

within said fluid space of said first bellows, said connecting member is pivotally connected to said first bearing lug fixed to said fixed frame at said first pivot point which is situated above said central axis, and is pivotally connected to said second bearing lug fixed to said bearing housing at said second pivot point, which is situated below said central axis; and within said fluid space of said second bellows, said connecting member is pivotally mounted to said first bearing lug fixed to said fixed frame at said first pivot point, which is situated above said central axis, and is pivotally connected to said second bearing lug fixed to said bearing housing at said second pivot point, which is situated below said central axis.

7. guide assembly for adjusting the direction of a web or fabric moving over a guide roll with respect to a fixed frame, comprising:

a movable bearing housing adapted to receive a bearing carrying an axle journal of the guide roll;

first and second bellows, each mounted on a respective side of said bearing housing and on respective sides of said fixed frame and defining an internal fluid space; and wherein said fluid space of each of said first and second bellows has situated therein, a first bearing lug having a first pivot point fixed with respect to said fixed frame;

a second bearing lug having a second pivot point fixed with respect to said movable bearing housing; and a connecting member pivotally connected at said first and second pivot points to said first and second bearing lugs, whereby said bearing housing is movable with respect to said fixed frame for positioning the axle journal of the guide roll by adjusting the pressure within said fluid space of at least one of said bellows to adjust the direction in which the web moves; and wherein, each of said connecting members comprises an arm section and a sleeve section at an end of said arm section;

each of said bearing lugs comprises a pair of spaced bearing plates; and each of said connecting members is pivotally connected to a respective bearing lug by pivot connection means including a bearing axle affixed to and extending between said spaced bearing plates of said bearing lug and through said sleeve section of said connecting member, and bearing means between said bearing axle and said sleeve section.

8. The guide assembly of claim 7 wherein said bearing means comprise conical roller bearings.

9. A guide assembly for adjusting the direction of a web or fabric moving over a guide roll with respect to a fixed frame, comprising:

a movable bearing housing adapted to receive a bearing carrying an axle journal of the guide roll;

first and second bellows, each mounted on a respective side of said bearing housing and on respective sides of said fixed frame, and defining an internal fluid space; and wherein said fluid space of each of said first and second bellows has situated therein, a first bearing lug having a first pivot point fixed with respect to said fixed frame;

a second bearing lug having a second pivot point fixed with respect to said movable bearing housing; and a connecting member pivotally connected at said first and second pivot points to said first and second bearing lugs, whereby said bearing housing is movable with respect to said fixed frame for positioning the axle journal of the guide roll by adjusting the pressure within said fluid space of at least one of said bellows to adjust the direction in which the web moves, and wherein, a central axis which passes through the center of said axle journal and both said fluid spaces;

within said fluid space of said first bellows, said connecting member is pivotally connected to said first bearing lug fixed to said fixed frame at said first pivot point, which is situated above said central axis, and is pivotally connected to said second bearing lug fixed to said bearing housing at said second pivot point, which is situated below said central axis; and within said fluid space of said second bellows, said connecting member is pivotally mounted to said first bearing lug fixed to said fixed frame at said first pivot point, which is situated below said central axis, and is pivotally connected to said second bearing lug fixed to said bearing housing at said second pivot point which is situated above said central axis.

10. A guide assembly for adjusting the direction of a web or fabric moving over a guide roll with respect to a fixed frame, comprising:

a movable bearing housing adapted to receive a bearing carrying an axle journal of the guide roll;

first and second bellows, each mounted on a respective side of said bearing housing and on respective sides of said fixed frame and defining an internal fluid space; and wherein said fluid space of each of said first and second bellows has situated therein, a first bearing lug having a first pivot point fixed with respect to said fixed frame;

a second bearing lug having a second pivot point fixed with respect to said movable bearing housing; and a connecting member pivotally connected at said first and second pivot points to said first and second bearing lugs, whereby said bearing housing is movable with respect to said fixed frame for positioning the axle journal of the guide roll by adjusting the pressure within said fluid space of at least one of said bellows to adjust the direction in which the web moves, and wherein, a central axis which passes through the central axis of said axle journal and both said fluid spaces;

within said fluid space of said first bellows, said connecting member is pivotally connected to said first bearing lug fixed to said fixed frame at said first pivot point, which is situated below said central axis, and is pivotally connected to said second bearing lug fixed to said baring housing at said second pivot point, which is situated above said central axis; and within said fluid space of said second bellows, said connecting member is pivotally mounted to said first bearing lug fixed to said fixed frame at said first pivotal point, which is situated above said central axis, and is pivotally connected to said bearing lug fixed to said bearing housing at said second pivot point, which is situated below said central axis.

* * * * *